United States Patent [19]

Hunt

[11] Patent Number: 4,583,580

[45] Date of Patent: Apr. 22, 1986

[54] CONTINUOUS CASTING METHOD AND INGOT PRODUCED THEREBY

[75] Inventor: Charles D. Hunt, Occidental, Calif.

[73] Assignee: Electro Metals, a division of Demetron, Inc., Union City, Calif.

[21] Appl. No.: 656,151

[22] Filed: Sep. 28, 1984

[51] Int. Cl.[4] ..... B22D 27/02; B22D 11/00

[52] U.S. Cl. ..... 164/469; 164/459; 164/900

[58] Field of Search ..... 164/459, 71.1, 469–471, 164/493–495, DIG. 900

[56] References Cited

U.S. PATENT DOCUMENTS

| | | | |
|---|---|---|---|
| 3,343,828 | 9/1967 | Hunt . | |
| 3,902,544 | 9/1975 | Flemings et al. | 164/900 X |
| 3,948,650 | 4/1976 | Flemings et al. . | |
| 3,951,651 | 4/1976 | Mehrabian et al. . | |
| 3,954,455 | 5/1976 | Flemings et al. . | |
| 4,089,680 | 5/1978 | Flemings et al. . | |
| 4,261,412 | 4/1981 | Soykan et al. . | |

OTHER PUBLICATIONS

"Solidification Processing," Merton C. Fleming, 1974 by McGraw Hill, Inc., pp. 58–91.

"Production of Superclean Material for Electronic and Power-Generator Application," H. Stephan, W. Dietrich, pp. 1–56, May 6, 1984.

*Primary Examiner*—Kuang Y. Lin

*Attorney, Agent, or Firm*—Fitch, Even, Tabin & Flannery

[57] ABSTRACT

A method is described for continuously casting an ingot of a metal alloy of a type having a substantial liquidus-solidus temperature range to produce internal microstructure of a desired fineness. Molten alloy is flowed along an electron beam heated skulled hearth while controlling the electron beam to maintain a solids content in the alloy on the hearth of between about 15% and about 40%. The alloy is poured from the hearth into the top of a continuous casting mold at a rate which produces a thixotropic region at the upper end of the fully solidified alloy in the mold. The ingot produced is characterized by a macrostructure in excess of one millimeter average grain dimensions with a non-uniform shape, orientation, and distribution, and is characterized by a microstructure of the order of fifty micron cell spacing of dendritic crystallites comprising the microstructure.

10 Claims, 3 Drawing Figures

CONTINUOUS CASTING METHOD AND INGOT PRODUCED THEREBY

This invention relates to metal casting and, more particularly, to an improved method of continuously casting an ingot of a metal alloy of the type having a substantial liquidus-solidus temperature range, and to an improved continuously cast ingot.

The continuous casting of ingots is a well known and widely used technique in the metal processing industry. Generally, the continuous casting process employs a continuous casting mold on a vertical axis having a cooled outer wall and a movable bottom or plug. Molten metal is poured into the top of the mold and, as the metal solidifies in the mold, it is drawn downwardly by the plug while at the same time additional molten metal is poured into the mold at the top.

In casting many alloys, the segregation of certain alloy constituents and various microscopic inclusions may result. Segregation problems are typically more prevalent where a substantial liquidus-solidus temperature range exists in the alloy, for example in excess of about 25° C., and particularly in the range of 75° C. to about 120° C. or more. Because the alloy does not immediately solidify, but rather solidifies gradually, two types of segregation may typically be encountered: macrosegregation and microsegregation. Macrosegregation, includes "freckling" and segregation at the grain boundaries. The latter problem may sometimes be eliminated by subsequent working and annealing of the alloy if the grains are not too large. Working breaks up and redistributes or recrystallizes the grains. Microsegregation, however, which typically occurs between the dendritic arms of the cell structure, and freckling, which is a brittle phase which forms in some alloys before dendrite growth, are not readily eliminated by subsequent working.

It is known that segregation problems can sometimes be reduced by avoiding slow local solidification rates. This is typically done by providing conditions which result in a relatively "steep" temperature gradient from liquidus to solidus phases. As solidification takes place in a typical alloy, it is known that primary dendrites grow from the solid into the liquid usually in the direction of heat transfer. Secondary arms then form extending outwardly from the sides of the primary dendrite. (As used herein, the terms "cell spacing" and "dendritic arm-spacing" mean the spacing between the secondary dendritic arms.) At higher solidification rates, the dendritic arm spacing is usually smaller, confining slower cooling material to a correspondingly smaller region. The result is that any segregation that occurs is within many finely and uniformly distributed regions, increasing homogenieity in the ingot with a consequent improvement in quality.

In some cases, high solidification rates may be accomplished by water sprays, baths of molten salts, or other similar systems. Where the continuous casting of the ingot is employed in connection with vacuum melting or processing of the alloy, such cooling systems are typically not feasible. Thus, continuous casting in vacuum is generally constricted in heat transfer to the mechanisms of radiant heat loss from the surface of the metal in the top of the mold, and heat loss to the mold walls and downwardly through the solidified portion of the ingot. Heat input is, of course, governed by the rate of pouring which corresponds to the rate of ingot withdrawal. By slowing the casting rate, a steeper liquidus-solidus temperature gradient may be achieved with a consequent reduction in segregation problems. However, this is achieved only at the cost of slower production rates. Moreover, the larger the input diameter, the greater the segregation problems because of the relatively slower cooling in the ingot core.

Various techniques in vacuum continuous casting systems for achieving rapid solidification rates are known. These techniques, however, typically have involved ingot rotation or agitation, with a consequent increase in cost and complexity of the casting system, or have achieved faster local cooling rates only at the expense of a reduction in casting rate.

It is an object of the present invention to provide an improved continuous casting method.

Another object of the present invention is to provide a continuous casting method by which segregation problems are significantly reduced without a consequent reduction in achievable casting rates.

Another object of the invention is to provide an improved continuously cast ingot.

A further object of the invention is to provide a continuously cast ingot in which major problems of macrosegregation and microsegregation are eliminated and which may be readily worked to eliminate problems of macrosegregation.

Other objects of the invention will become apparent to those skilled in the art from the following description, taken in connection with the accompanying drawings wherein.

Very generally, the method of the invention includes the use of an electron beam heated skulled hearth on which the molten alloy to be continuously cast flows. The solids content of the alloy on the hearth is controlled by appropriate heating to maintain a solids content in the alloy on the hearth of between about 15% and 40%. Molten alloy is poured from the hearth into the top of a continuous casting mold at a rate sufficient to cause the maintenance of a substantial thixotropic region at the upper end of the fully solidified ingot in the mold and below the region at which the molten alloy from the hearth enters the mold. The solids content in the thixotropic region is at least about 50%. The solidified ingot is withdrawn from the mold at a rate of between about 0.15 kilograms per hour per square centimeter of transverse cross-section of ingot and 0.90 kilograms per hour per square centimeter.

The ingot of the invention is comprised of a reactive alloy having a substantial liquidus-solidus temperature difference and a high melting point and is characterized by a macrostrucure in excess of about one millimeter average grain dimensions with a non-uniform shape, orientation and distribution. The characteristic microstructure is of the order of fifty microns cell spacing of dendritic crystallites comprising the microstructure.

Figure 1:
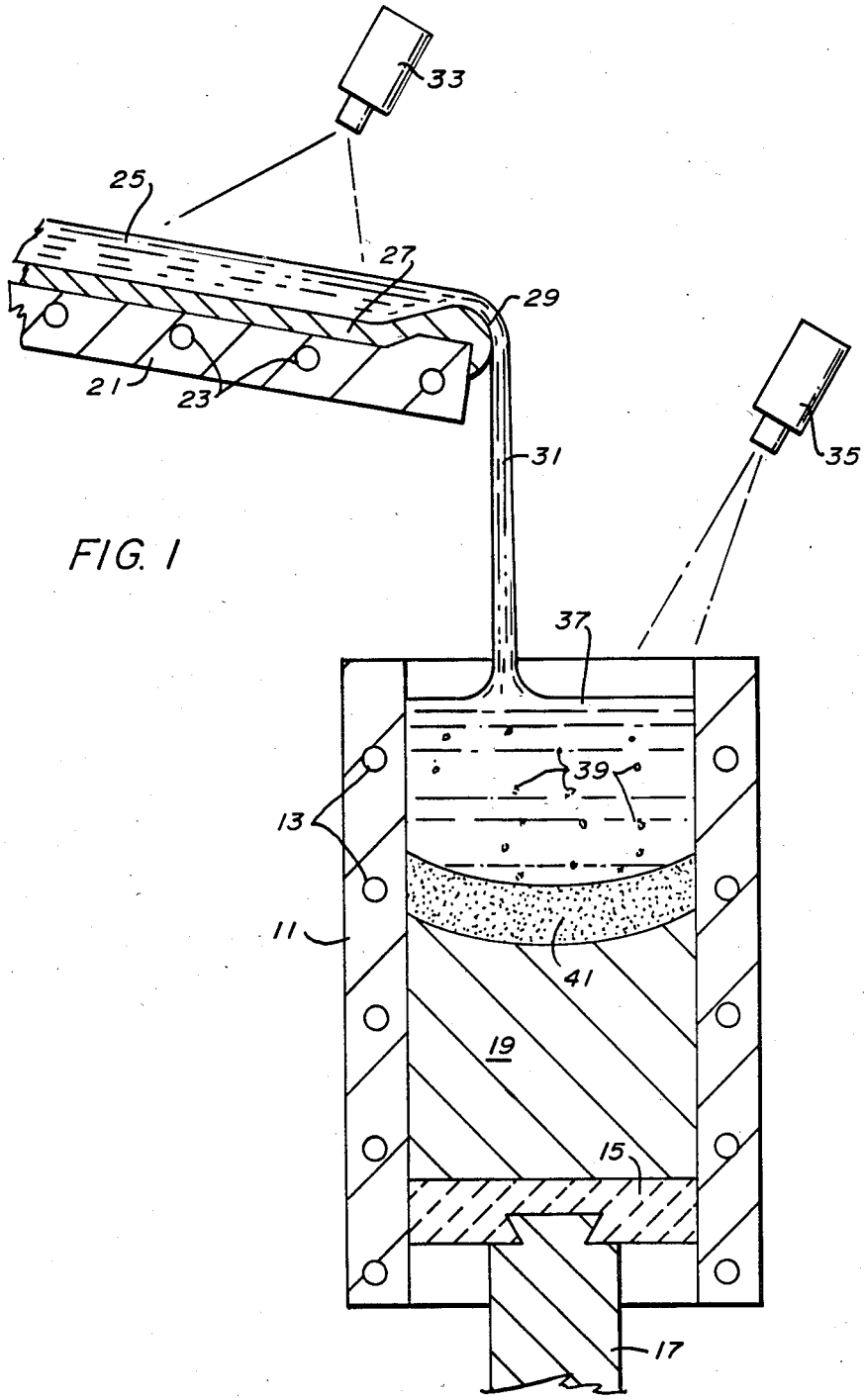
FIG. 1 is a schematic cross-sectional view of a continuous casting furnace in which the method of the invention may be employed, and illustrating certain aspects of the method of the invention.

Referring now particularly to FIG. 1, a continuous casting mold 11 is depicted schematically as it would appear in a vacuum enclosed casting furnace (not shown). The wall of the mold 11 is substantially cylindrical and is provided with coolant passages 13 therein. A lower plug 15, which may be of ceramic or other suitable material, is supported at the lower end of the mold 11 by a rod 17 which withdraws the plug from the mold as the ingot is being continuously cast. The solid portion of the ingot being cast in the mold is shown at 19.

A hearth 21 is also disposed within the evacuated furnace and is provided with coolant passages 23 therein. Molten alloy 25 on the hearth is cooled in the region adjacent the hearth to form a solidified skull 27. The alloy on the hearth is heated and a slight hydraulic head is maintained to cause the molten alloy 25 to flow down the hearth over a lip 29 formed in the skull and down in a stream 31 to the open top of the mold 11. The material on the hearth 21 is heated by a suitable electron beam gun 33 and, as will be explained, a portion of the molten material on the top of the mold 11 is heated by a suitable electron beam gun 35. An electron beam hearth furnace for continuously casting ingots is shown and described, for example, in U.S. Pat. No. 3,343,828.

The current invention is based upon the recognition that, in ingots prepared in accordance with the methods of this invention the microstructure, not the macrostructure, determines the ultimate quality of many types of continuously cast alloys. It is microsegregation that adversely affects the forging characteristics of ingots and the properties of forged items made from ingots. The smaller the cell spacing observed in the microstructure, the lower the degree of segregation in the cast structure and the better the forging characteristics of the ingot and the toughness and ductility of the forged part. In many cases the macrostructure (i.e. the grain structure) is of considerably less importance than the microstructure, since the macrostructure may be readily modified by working and annealing the ingot after it is cast.

Conventional continuously cast a11oy ingots from vacuum have highly non-uniform microstructures, with cell spacings ranging from about 50 microns in the outer half-inch of ingot periphery to greater than 250 microns in the central regions of ingots larger than about 40 or 50 centimeters diameter. This central zone of relatively coarser cell spacing causes ingot breakdown problems during forging and results in reduced toughness and ductility in finished parts. Such problems are particularly acute in connection with high strength wrought super alloys, such as Inco 718DA (International Nickel). Since large forged parts such as for use in aircraft engines can only be made from ingots of 40 or 50 centimeters or larger, the coarse cell spacing in the central zone of the ingot is a particularly acute problem.

Experiments in connection with molding of slush or thixotropic mixtures has yielded good refinement of microstructure in cast alloys. See for example U.S. Pat. No. 4,089,680 and U.S. Pat. No. 3,948,650. The basic techniques described in the foregoing patents involve the maintenance of fluid characteristics in a thixotropic mixture by applying sufficient shear forces to result in a homogenous distribution of the finely divided solids in the mixture. As a result, during the cooling process, the dendritic cell spacing stays extremely fine, confining any unsolidified alloy to a very narrow space with a consequent refinement in microsegregation of the alloy constituents. See for example Flemings, *Solidification Processing*, pages 77–85, McGraw Hill Book Company, New York, 1974.

Referring again to FIG. 1, the process of the invention produces a thixotropic condition at the liquid-solid interface at the top of the solidifying ingot in the mold. As a result, the dendritic arm spacing is maintained at a minimal level with a consequent reduction in the segregation phenomenon. This is done by creating, in an electron beam heated skulled hearth, a fluid metal phase that is not fully molten but which contains a significant fraction of finely divided crystallite solids of dendritic shape. In doing so, the molten pool on the hearth is maintained at a relatively shallow depth, for example, between about ½ and 1 centimeter and with a percent solids of between about 15% and 40%. In this range, the behavior of the alloy in the hearth is essentially non-viscous, particularly when subjected to the relatively mild shear forces present in the flowing affect on the tilted hearth. An analogy of the condition of the alloy on the hearth may be made to material such as tomato catsup, alluvial clays, marsh lands, etc., all of which briefly become "non-viscous liquids" during the period of time that sufficient shear force is applied. Mud slides, earthquake caused subsidence of houses on alluvial deposits, and unexpected splats of tomato catsup onto french fried potatoes are examples of rapid transitions of thixotropic materials from the self-supporting state to the non-viscous state.

In accordance with the invention, electron beam power is applied onto the top surface of the metal resting on the hearth to obtain a molten pool which is of substantial solids content but which is fluid enough for the metal to flow readily along the hearth and over the pouring lip. Thus, the "molten" material in the hearth contains no more than about 15% to 40% solids. The shallow molten pool is contained within a skull of fully solidified material. The average depth of the molten alloy in the hearth is maintained between about 0.75 centimeters and 1.5 centimeters. The heating of the pool on the hearth is controlled relative to the throughput rate so that the local cooling rate at the surface corresponds to about 50° per second.

In accordance with a further and significant feature of the invention, the molten metal pouring from the hearth into the open top of the continuous casting mold is not heated except immediately adjacent the sidewall of the mold. Heating adjacent the sidewall of the mold is provided by the electron beam gun 35 to maintain the integrity of the sidewall of the ingot, thus avoiding cold shuts. However, the avoidance of heating over the major portion of the surface of the alloy in the mold 11 results in substantial and immediate cooling of the alloy as a result of radiant heat loss from the pool surface. Although not fully understood, it is believed by applicant that the fluid metal flowing into the mold, containing somewhere between 15% and 40% or so fraction of solids is immediately cooled and further dendrite formation occurs as a result of this radiant cooling upward from the unheated portion of the top surface of the molten pool. This dendritic formation occurs in a very thin layer having a cooling rate estimated to be between about 10° C. and 200° C. per second and probably about 50° C. per second. The estimate of this cooling rate is made from observed cell spacing of dendritic crystallites in the ingot, which is about 50 microns, corresponding to the cooling rate mentioned above.

Dendritic crystallites with a cell spacing of 50 microns thus solidify in this very thin top layer and these crystallites, together with other crystallites present already in the material flowing into the mold from the hearth sink downwardly toward the top of the solid portion of the ingot. The result is the formation of a zone or layer 41 which is essentially thixotropic in character comprised of more or less fully solidified material with the solid fraction in the zone being above about 50% and probably closer to 60%. This zone, consisting of randomly oriented crystallites of about 500 micron cross-sectional size and about 50 micron cell spacing is sufficiently viscous that no further liquid migration can occur within it.

Final solidification of this thixotropic zone 41 occurs as a result of heat conduction outwardly to the sidewalls of the mold and downwardly through the solidified portion 19 of the ingot to the relatively colder environment surrounding the ingot. Grain growth as a result of such slower cooling rate will occur, resulting in some macroscopic segregation. However, such macroscopic segregation is minimized due to the thirotropic nature of the region in which solidification takes place. Freckling is also minimized or eliminated for the same reason. Any remaining macroscopic segregation is readily be eliminated through further working and annealing of the ingot.

This unusual condition of the ingot, namely relatively large grain structure and a finely divided microstructure, is characteristic of ingots produced in accordance with the invention. Such structure results from the fact that finely divided microstructures form when slow solidification occurs only when the liquid that is still present is essentially isolated in very small volumes by the finely divided solidified particles. Segregation can occur only on a very small scale (see Flemings, supra).

Figure 2:
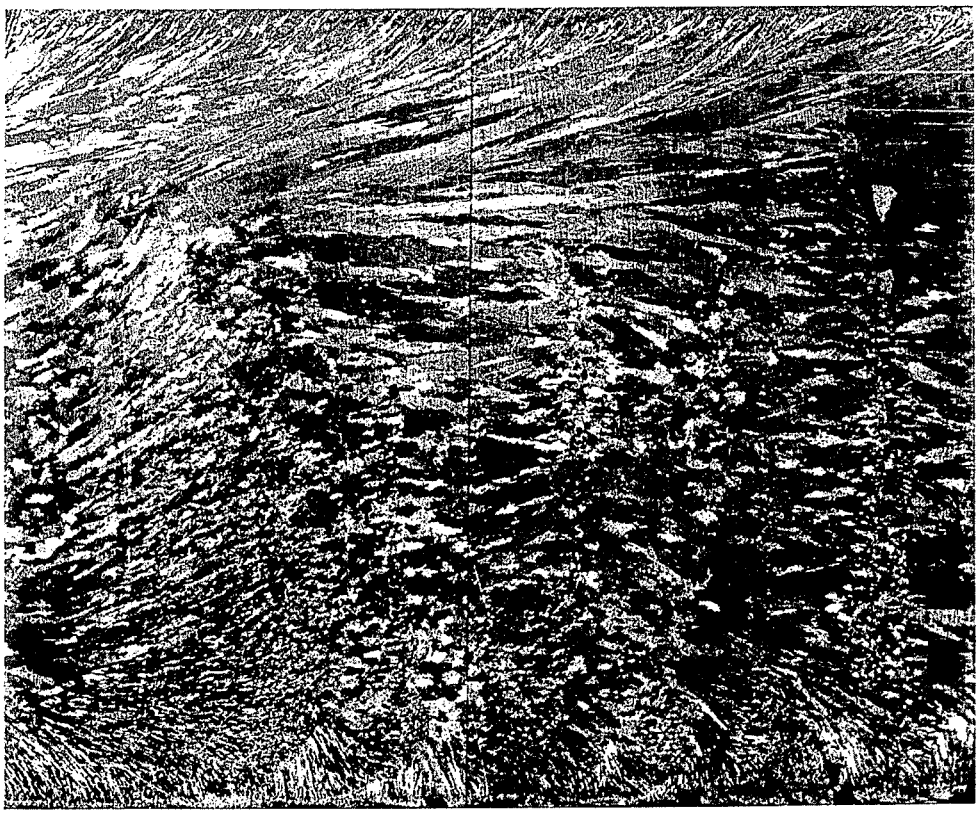
FIG. 2 is a cross-sectional photograph at a scale of 1:⅔ of the macroscopic structure of an ingot produced according to the invention.

Referring now to FIG. 2, a typical macrostructure ingot cross-section is shown, representing, at nearly full scale, a portion of the ingot of the invention. It may be seen that some regions of the ingot are essentially elongated columnar grain structure whereas other regions are finely and more randomly divided grain structure. The overall grain size is in excess of about one millimeter and is typically two to four millimeters.

Figure 3:
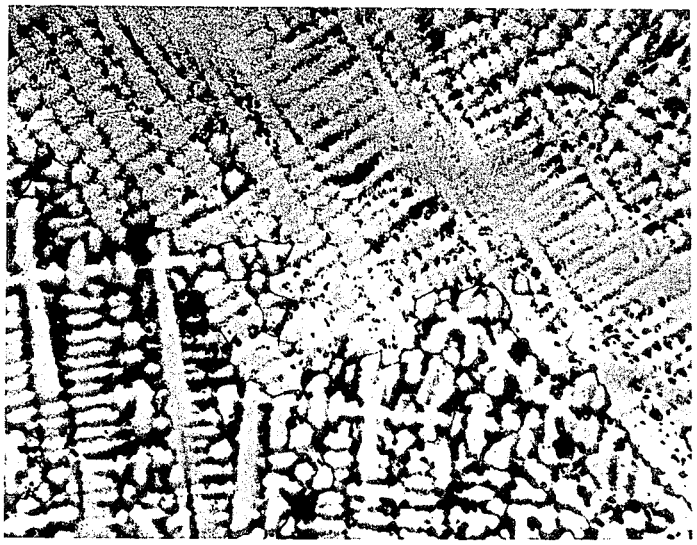
FIG. 3 is a cross-sectional photomicrograph, magnified fifty times, of the microscopic structure of an ingot produced according to the invention.

Referring now to FIG. 3, the illustration therein is a photomicrograph magnified fifty times of a cross-section of an ingot of the invention. In FIG. 3 it may be seen that the individual dendrites are essentially randomly oriented in many cases, although in some cases are more directionally oriented. The cell spacing is about 50 microns average with the consequent reduction in segregation as mentioned above.

The rate of withdrawal of the ingot preferably is between about 0.15 kilograms per hour per square centimeter and 0.90 kilograms per hour per square centimeter. The pouring rate, of course, would correspond to this casting rate. The ingot may be withdrawn continuously or may be withdrawn in a series of preselected increments. In the latter case, a certain variation in the macrostructure may be observed as a layering effect. The microstructure is essentially independent of this layering effect. The depth of the non-thixotropic molten alloy at the top of the ingot in the mold is preferably maintained between about one fourth the diameter of the ingot and three times the diameter of of the ingot. Of course, the upper rate of withdrawal of the ingot will be limited to that which will prevent sidewall bulging or breakout in the withdrawn ingot.

The type of alloys to which the process of the invention is particularly applicable are those which have a liquidus-solidus temperature range between about 50° C. and 150° C., which have a melting point in excess of about 1,300° C., and which are reactive in the sense that they will readily react with gas or other solids and therefore are preferably processed in an evacuated environment and under skulled conditions. Typical alloys for which the invention is suitable include nickel or cobalt base alloys containing at least about 50% base material and between about 10% and 25% chromium.

The following examples are provided by way of illustration and are not meant to limit the scope of the invention:

EXAMPLE I

A one thousand pound eight inch diameter ingot of alloy INCO 718 was cast at one hundred pounds per hour in a two hundred fifty kilowatt electron beam cooled hearth furnace, following the method of the invention. The molten pool in the hearth was maintained at a depth of about five to ten millimeters and the depth of the non-thixotropic molten alloy at the top of the ingot was maintained at about one fourth the diameter of the ingot. The ingot was withdrawn from the mold continuously and electron beam heating of the upper surface of the molten alloy in the mold was provided only adjacent the mold walls. This left an area of about forty square inches at the top of the mold which was unheated.

Electron beam power used totalled 130 kilowatts, with 10–15 kilowatts being directed at the ingot periphery, 50 kilowatts on the hearth, and 65 kilowatts on the melt stock, not shown in the drawings.

The microstructure of the cast ingot consisted of dendritic crystallites with about a fifty micron cell spacing, unform throughout the ingot and independent of grain macrostructure. The grain macrostructure was variable in appearance and quite unrelated to the microstructure. After casting, the ingot was heat treated and worked conventionally to produce four inch RCS billets having a uniform gran size of ASTM 4–5. The mechanical properties of the billets exceeded aerospace specification requirements as set forth in General Electric aircraft engine applications for premium quality DA718 alloy, CF50PF71, temporary specifications of June 2, 1981.

EXAMPLE II

The conditions of Example I were repeated with the same alloy at a casting rate of two hundred pounds per hour to produce a one thousand pound ingot. The microstructure of the ingot was identical with that of the ingot of Example I. The macrostructure of the ingot was similar to that of Example I. The ingot was processed conventionally and upset forged into eight inch diameter disks, one inch thick. The mechanical properties were in excess of those specified in Example I.

EXAMPLE III

The conditions of Example I were repeated in casting a one thousand pound ingot of the same alloy at a casting rate of three hundred fifty pounds per hour. The microstructure of the ingot was essentially identical to that of Example I and the macrostructure was similar. The ingot was processed conventionally and upset forged to eight inch diameter disks, one inch thick. Mechanical properties exceeded the specifications set forth in Example I.

EXAMPLE IV

The conditions of Example I were repeated in casting an ingot of "Rene 95" alloy at a casting rate of three hundred fifty pounds per hour. The microstructure of the ingot was essentially the same as that of Example I above and the macrostructure was similar. Mechanical properties exceeded the specifications set forth in General Electric Specification No. C50TF64-52.

EXAMPLE V

An ingot of "Waspaloy" was cast under conditions identical with that of Example I at a rate of three hundred fifty pounds per hour. The microstructure of the ingot was essentially the same as that of Example I above and the macrostructure was similar. Mechanical properties exceeded the specification requirements set forth in Garrett Turbine Engine Company Specification No. EMS 52517.

It may be seen, therefore, that the invention provides an improved method for continuously casting alloys, and to an improved ingot of such alloys. High refinement of microstructure is achieved without compromising casting rates. Complex casting systems, such as systems for rotating the ingot while being cast, are not required by the invention. Various modifications of the invention will become apparent to those skilled in the art from the foregoing description and accompanying drawings. Such modifications are intended to fall within the scope of the appended claims.

What is claimed is:

1. A method of continuously casting an ingot of a metal alloy of a type having a substantial liquidus-solidus temperature range to produce internal microstructure of a desired fineness, said method comprising:

flowing the molten alloy along an electron beam heated skulled hearth while controlling the electron beams to maintain a solids content in the alloy on the hearth of between about 15% and about 40%, pouring the molten alloy from the hearth into the top of a continuous casting mold at a rate sufficient to cause the maintenance of a fluid pool at the top of the ingot and a substantial thixotropic region below the pool at the upper end of the fully solidified portion of the alloy in the mold and below the region at which the molten alloy from the hearth enters the mold, said thixotropic region having a solids content of at least about 50%, and withdrawing the solidified alloy from the mold at a rate of between about 0.15 kilograms per hour per square centimeter and 0.90 kilograms per hour per square centimeter.

2. A method according to claim 1 wherein the surface of the alloy in the top of the mold is heated by electron beam heating at the periphery adjacent the mold to provide a relatively smooth sidewall.

3. A method according to claim 1 wherein the solidified is withdrawn continuously.

4. A method according to claim 1 wherein the solidified alloy is withdrawn in a series of preselected increments.

5. A method according to claim 1 wherein the ingot is formed of an alloy having a liquidus-solidus temperature range between about 50° C. and 150° C.

6. A method according to claim 1 wherein the alloy is a nickel or cobalt base alloy containing at least about 50% nickel or cobalt, respectively, and between about 10% and 25% chromium.

7. A method according to claim 1 wherein the depth of non-thixotropic molten alloy at the top of the ingot in the mold is between about one fourth the diameter of the ingot and three times the diameter of the ingot.

8. A method according to claim 1 wherein the hearth conditions and the pourihg rate is controlled so that the local cooling rate at the surface of the molten alloy in the hearth and the mold corresponds to about 50° C. per second.

9. A method according to claim 1 wherein the average depth of the molten alloy in the hearth is maintained between about 0.75 centimeters and 1.5 centimeters.

10. A method of continuously casting an ingot of a metal alloy of a type having a substantial liquidus-solidus temperature range to produce internal microstructure of a desired fineness, said method comprising:

flowing the molten alloy along an electron beam heated skulled hearth while controlling the electron beams to maintain a solids content in the alloy on the hearth of a predetermined percentage, pouring the molten metal from the hearth into the top of a continuous casting mold while heating the surface of the alloy in the top of the mold by electron beam at the periphery of the ingot adjacent the mold to provide a relatively smooth side wall, while avoiding substantial heating of the ingot in any other region, and controlling the predetermined solids content of the alloy on the hearth and the pouring rate of the molten alloy from the hearth into the top of the continuous casting mold to cause the maintenance of a fluid pool at the top of the ingot and a substantial thixotropic region below the pool at the upper end of the fully solidified portion of the alloy in the mold and below the region at which the molten alloy from the hearth enters the mold, said thixotropic region having a solids content of at least about 50%, and withdrawing the solidified ingot from the mold.

* * * * *